United States Patent [19]

Sturges, Jr.

[11] Patent Number: 4,503,506

[45] Date of Patent: Mar. 5, 1985

[54] APPARATUS FOR MAPPING AND IDENTIFYING AN ELEMENT WITHIN A FIELD OF ELEMENTS

[75] Inventor: Robert H. Sturges, Jr., Plum Borough, Pa.

[73] Assignee: Westinghouse Electric Corp., Pittsburgh, Pa.

[21] Appl. No.: 289,955

[22] Filed: Aug. 5, 1981

[51] Int. Cl.[3] ..... H04N 7/18; G06F 15/20

[52] U.S. Cl. ..... 364/513; 358/100; 165/11 A

[58] Field of Search ..... 358/101, 107, 100; 364/559, 513; 165/11 A

[56] References Cited

U.S. PATENT DOCUMENTS

| | | | |
|---|---|---|---|
| 3,041,393 | 6/1962 | Hennig | 358/100 |
| 3,637,997 | 1/1972 | Petersen | 235/92 N |
| 3,783,189 | 1/1974 | Nelson | 178/6.8 |
| 3,810,138 | 5/1974 | Thompson et al. | 340/225 |
| 3,994,173 | 11/1976 | Ward et al. | 250/497.1 |
| 4,021,840 | 5/1977 | Ellsworth et al. | 358/101 |
| 4,146,924 | 3/1979 | Birk et al. | 364/513 |
| 4,190,857 | 2/1980 | Creek et al. | 358/225 |
| 4,203,132 | 5/1980 | Schmitt et al. | 358/101 |
| 4,205,939 | 6/1980 | Reyes | 165/11 A |
| 4,231,419 | 11/1980 | Gugel | 165/11 A |
| 4,347,652 | 9/1982 | Cooper, Jr. et al. | 165/11 A |

*Primary Examiner*—Felix D. Gruber
*Assistant Examiner*—Thomas Black
*Attorney, Agent, or Firm*—L. A. DePaul

[57] ABSTRACT

Apparatus for identifying an element within an array of elements, is disclosed as including a sighting device that is disposable in a plurality of positions to facilitate the operator to position the device in an orientation so that the device is aligned with or sighted upon the element within the array, operator-controllable means coupled to the sighting device to permit the operator to variably position the sighting device, an orientation sensing means coupled to the sighting device to provide an output signal indicative of the particular orientation of the device and computing means responsive to the position indicating signals to provide a manifestation indicating the element's position within the field, as sighted by the operator.

13 Claims, 8 Drawing Figures

APPARATUS FOR MAPPING AND IDENTIFYING AN ELEMENT WITHIN A FIELD OF ELEMENTS

BACKGROUND OF THE INVENTION

Description of the Prior Art

This invention, in its preferred form, relates to apparatus for locating within a spatial field a particular element and for providing an output signal indicative of its relative position, e.g. in terms of its X,Y coordinates within the spatial field. More particularly, the invention relates to apparatus for sighting a tube of a nuclear steam generator, and for providing the coordinates of that tube within an array of a large number of similar tubes.

A nuclear steam generator 60 of the type found in the art is shown in FIGS. 3A, B and C, of the attached drawings, as comprising an array of a large number of vertically oriented U-shaped tubes 32. The tubes 32 are disposed in a cylindrical portion 46 of the generator 60 whose bottom end is associated with a radiation confining housing or channel head 48, typically having a bottom portion or bowl 49 of a hemi-spherical configuration as shown in FIG. 3. The channel head 48 is divided by a vertical wall 50 into a first quadrant or portion 58 typically known as the hot leg, and a second quadrant or portion 56 typically known as the cold leg. As generally shown in FIG. 3, a first or input tube 52 supplies hot steam to the hot leg 58, whereas an output tube 54 is coupled to the cold leg 56. The hot steam entering the hot leg 58 passes into the exposed openings of the plurality of U-shaped tubes 32, passing therethrough to be introduced into the cold leg 56. As shown in FIG. 3, the steam entry openings of the tubes 32 are supported within openings of a first semicircularly shaped tubesheet portion 38*a*, whereas the exit openings of the tubes 32 are supported within openings of a second semicircularly shaped tubesheet portion 38*b*. Collectively, the tubesheet portions 38*a* and *b* are termed the tubesheet 38.

Maintenance of the nuclear steam generator requires visual inspection of the tubes, which may be carried out in a safe manner by disposing a video camera within the radiation confining housing as described in U.S. Pat. No. 3,041,393, whereby an operator may orient the video camera in a variety of directions so that the interior of the housing may be visually inspected. As disclosed in the noted patent, the video camera is disposed within the housing and is rotated, while producing video signals that are transmitted externally of the housing and viewed on a suitable CRT monitor. Thus, the operator is not exposed to the intense radiation that exists within the housing.

Maintenance of the large number of tubes 32 is effected typically by removing from service a defective tube, i.e., a tube with an opening therein from which radioactive water may escape, by plugging each end of the defective tube 32. "Plugging" is carried out by entering a first portion of the channel head 48 to seal first one end of its defective tube 32 and then entering the second portion 56 of the channel head 48 to seal the other end of the tube 32. To this end, a manway or port 62 is provided by which an operator may enter the hot leg 58, and a manway 64 is provided to enter the cold leg 56. Plugging is carried out by first identifying the end of the defective tube 32 and then inserting an explosive type plug, having a cylindrical configuration and being tapered from one end to the other. The plug is inserted into the opening of the defective tube 32, and after the operator has exited the channel head 48, the plug is detonated thereby sealing that end of the tube 32. Processes other than plugging, such as welding, may be used to seal tube ends. Thereafter, the operator locates the other end of the defective tube 32, and thereafter plugs the other end in the manner described above. As shown in FIGS. 3B and 3C, each of the manways 52 and 54 are disposed approximately 45° from the vertically disposed wall 50 in a manner as shown in FIG. 3C, and approximately 45° from the horizontal plane of the tubesheet 38 as shown in FIG. 3B. In an actual embodiment, the channel head is in the order of 10 feet in diameter, the manways 16 inches in diameter, and the input and output tubes 52 and 54 three feet in diameter.

The difficulty in plugging the ends of the tubes 32 arises in that there are a large number of such tubes 32 typically being in the order of 3,500 to 4,500 tubes. Typically, an observation is made within the cylindrical portion 46 of the steam generator 60 to locate that defective tube noting its position within the array of tubes 32 by its row and column. Thereafter, the operator enters the channel head 48 to search for the defective tube 32 by counting the rows and columns to that defective tube 32 of the array known to be defective. Searching for a particular defective tube 32 is tedious under the conditions that exist within the channel head 48. Typically, the temperature within the channel head 48 is in the order of 120° to 130° F. with a 100% humidity. In addition, there is a high degree of radiation, which is in the order of 10 to 50 rads per hr.; to maintain safe exposure levels to the operator, the operator may stay within the channel head 48 for a maximum period of only 5 to 10 minutes. Operator error under such conditions is great. Alternative methods of identifying a defective tube 32 have contemplated the use of a template affixed to each of the tubes 32, the template bearing symbols that are recognized by the operator. However, where the tubes are so identified or the operator locates the tube by counting rows and columns, the operator may be exposed to a high degree of radiation, which degree of exposure is desired to be lessened.

The prior art has suggested various mapping apparati of an optical type that are disposed within the channel head to facilitate the location of a particular tube within the field or array of similar tubes. Typically, a light beam source, e.g. a laser, is mounted on the floor of the channel head and is directed towards the tubesheet, i.e, the array of the ends of the tubes 32 as mounted by the ceiling 44. The laser is steerable by an operator or a computer remote control so that its projected beam falls upon a particular tube, thus identifying that tube to the operator. The orientation of the laser is steerable by the operator and can be made to point to a particular tube. In addition, a video camera is also disposed within the channel head to view the array so that the operator can steer or orient the laser so that its beam falls upon the tube of interest. The laser or light source is coupled to appropriate position sensors, which provide output signals indicative of the laser beam orientation; such position signals are in turn used to provide the coordinates of the identified tube. However, such systems are subject to error in that the operator may misinterpret which tube the light spot has fallen upon in that the beam cannot be made to be reflected from the center of a tube unless it is plugged solid so that the tube may reflect light. Also, such systems require the operator to not only orientate the light source but also the video camera, unless additional servo controls are applied to the video camera.

U.S. Pat. No. 4,146,924 discloses a system involving a plurality of video cameras whose output signals are applied to a computer, which in turn calculates a set of coordinates of an object as sighted by the video cameras, within a field. Apparently, the operation of this system requires the use of at least two video cameras and the placement of a visual programming device, whereby a computation of the coordinates of the object can be achieved.

SUMMARY OF THE INVENTION

It is therefore an object of this invention to identify an element within a field or array of similar elements and to provide a manifestation indicative of the element's position.

It is a more specific object of this invention to provide an indication of the position of an element within a field or array of similar elements in a simple and efficient manner.

It is a still further object of this invention to permit an operator to observe an element within a hazardous area and to provide an indication of the position of that element without imposing a risk to the operator.

In accordance with these and other objects of the invention, there is disclosed apparatus for identifying an element within an array of elements, including a sighting device that is disposable in a plurality of positions to facilitate the operator to position the device in an orientation so that the device is aligned with or sighted upon the element within the array, operator controllable means coupled to the sighting device to permit the operator to variably position the sighting device, an orientation sensing means couled to the sighting device to provide an output signal indicative of the particular orientation of the device and computing means responsive to the position indicating signals to provide a manifestation indicating the element's position within the field, as sighted by the operator.

In an illustrative embodiment of this invention wherein the element identifying apparatus is adapted to identify an object disposed within a dangerous environment, i.e., an environment wherein there is a high level of radiation, the sighting device may take the form of a video camera that is disposed within the environment, and there is further included a display device in the form of a cathode ray tube (CRT) that is disposed externally of the dangerous environment. The operator may view upon the CRT the image seen by the video camera and may sight the video camera with the aid of a reticle imposed between the sighted field and the video camera, whereby when the reticle is aligned with the element as viewed upon the CRT, the output of the orientation sensing means identifies with a high degree of accuracy the position of the element.

In operation, the element-identifying apparatus is variably disposed with respect to the array of elements, all of the elements lying within a plane. The sighting device is aligned with at least three elements within the known plane, whereby corresponding reference lines between the sighting device and the three elements are defined. Subsequently, the sighting device is aligned with respect to a further element within the plane, whose position is not known, to establish a reference line therebetween. The orientation sensing means provides an output signal indicative of the position of the new reference line, whereby the position and in particular the coordinate position of the unknown element within the array plane may be determined. In a particular embodiment, the output of the orientation sensing means in the form of resolvers coupled to the video camera, is applied to a computer which calculates the X,Y coordinates corresponding to the row and column in which a tube of a nuclear steam generator is disposed within the plane of the tubesheet.

BRIEF DESCRIPTION OF THE DRAWINGS

A detailed description of a preferred embodiment of this invention is hereafter made with specific reference being made to the drawings in which.

DESCRIPTION OF THE PREFERRED EMBODIMENT

Figure 1:
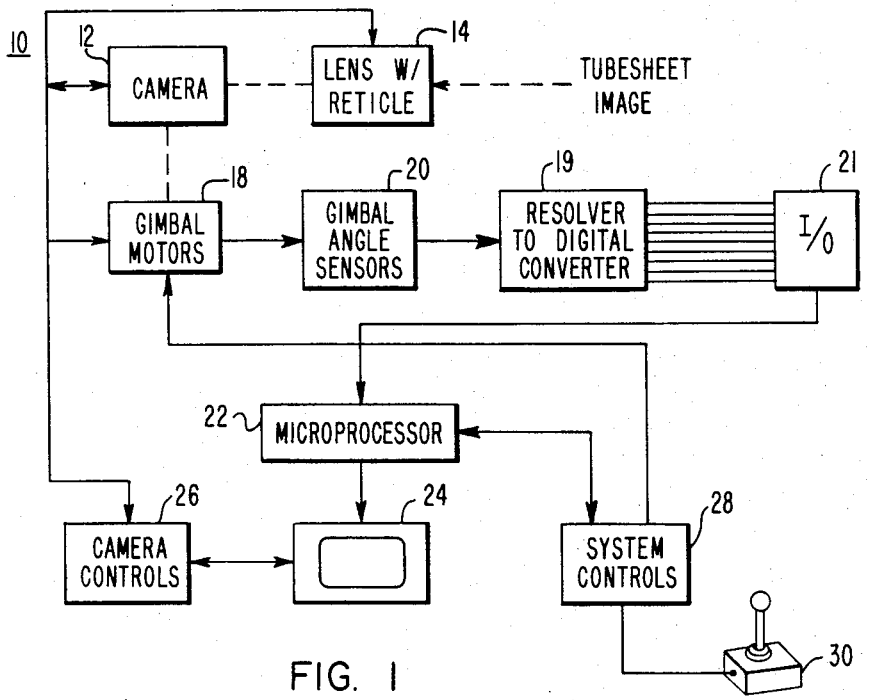
FIG. 1 is a functional block diagram of the system for sighting a video camera upon an element within an array of elements, and for using the output of the video camera to determine the position and in particular the coordinate position of the element within the field, in accordance with teachings of this invention.
Figure 3A:
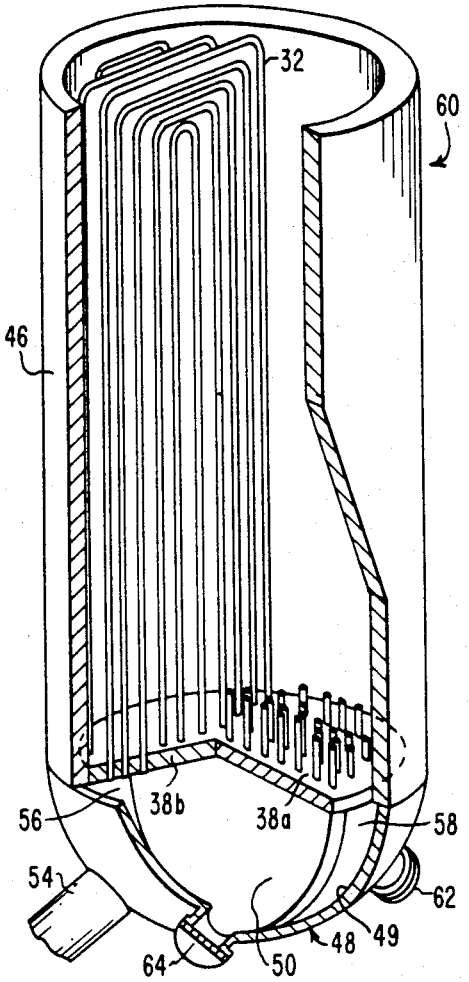
FIGS. 3A, 3B and 3C are respectively a perspective view of a nuclear steam generator showing the mounting of the plurality of tubes therein, a side view of the channel head of the nuclear steam generator, and a bottom view of the channel head particularly showing the placement of the input and output tubes, and the manways.
Figure 3B:
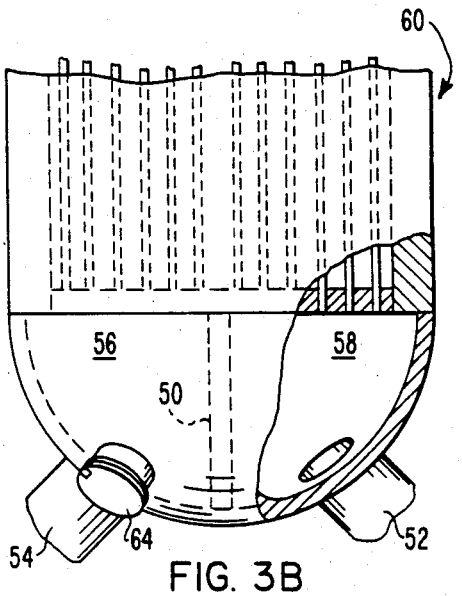
Figure 3C:
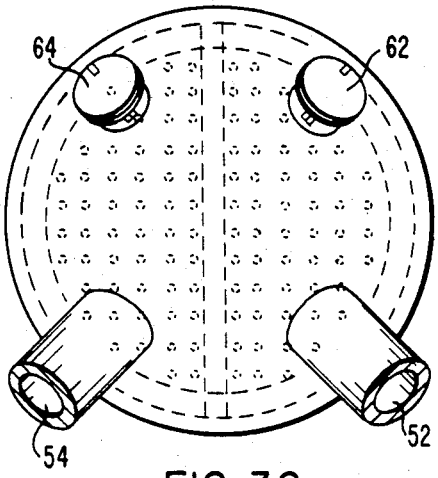
Figure 4:
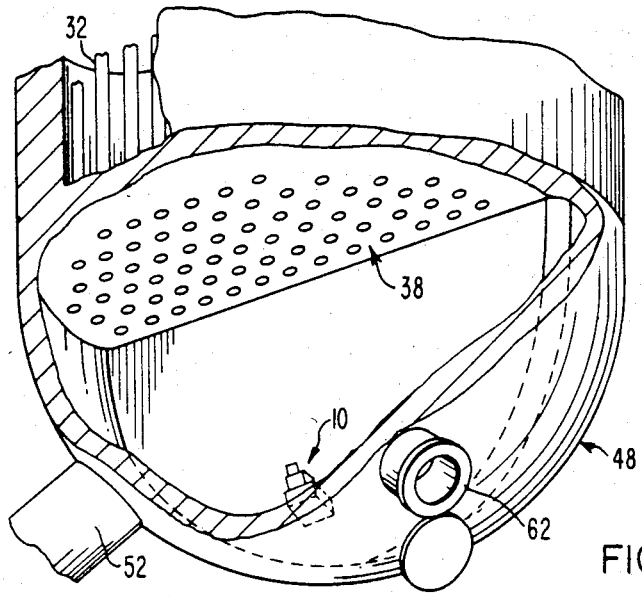
FIG. 4 is a further perspective view of the channel head of the nuclear steam generator in which the sighting system of this invention may be disposed.
Figure 5:
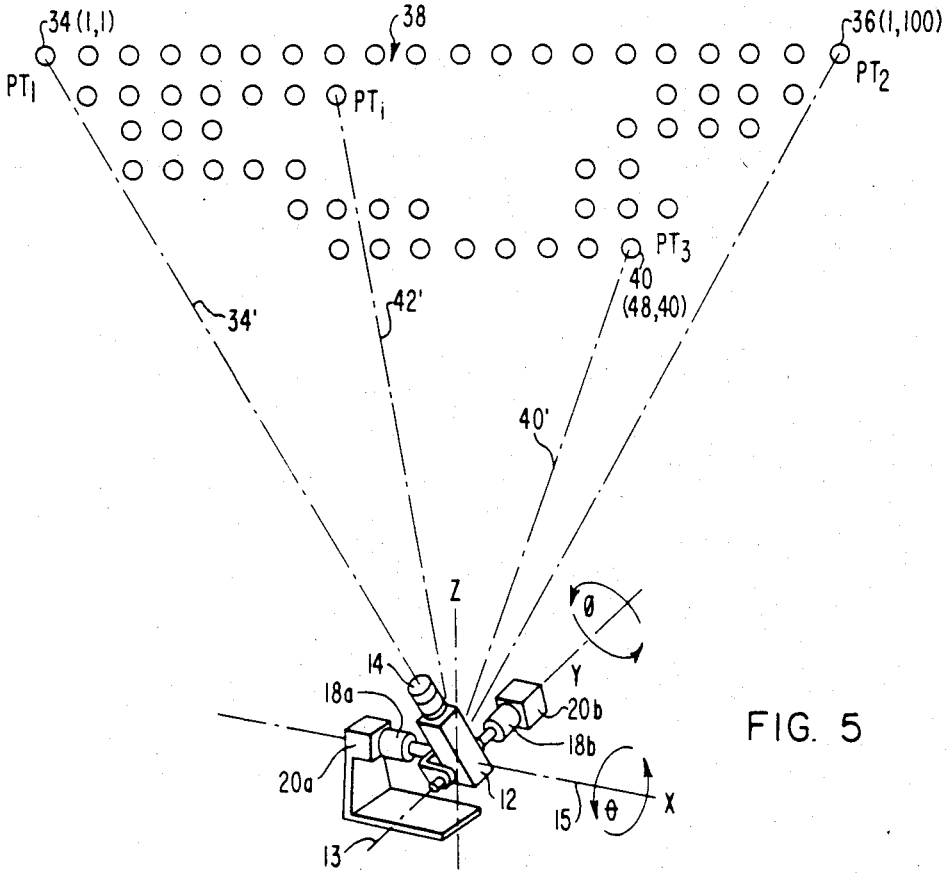
FIG. 5 is a perspective view of an array or field of elements, e.g., tubs of the nuclear steam generator shown in FIGS. 3 and 4, and a video camera as shown in FIG. 1, which camera may be oriented to sight upon and to thereby identify one of the plurality of tubes; and, FIG. 6 shows a perspective view of a set of space defining axes in which three reference lines are established by sighting the video camera, as shown in FIG. 5, upon known elements or tubes of the array and thereafter for sighting upon an unknown element, whereby its position within the plane of the array may be readily determined.

Referring now to the drawings and in particular to FIG. 1, there is shown a mapping and identifying system 10 comprising a video camera 12 that is mounted upon a gimbal, as is well known in the art to be rotatable about a first axis 13 and a second axis 15 disposed perpendicular to the first axis 13, (see FIGS. 5 and 6) whereby the video camera 12 may be variably disposed to sight any of a plurality of elements or tubes 32, as shown in FIG. 3. In an illustrative embodiment of this invention, the elements or tubes 32 are a part of a nuclear steam generator 60 (see FIGS. 3 and 4) and are disposed within a channel head 48, a confined area that is highly radioactive. In such an illustrative example, the video camera 12 may be mounted either on a nozzle cover or a fixture reference to the manway, or placed on the bottom of the bowl 49. The video camera 12, as shown in FIGS. 1 and 5, is associated with gimbal motors identified in FIG. 1 by the numeral 18 and more specifically in FIG. 5, as a first gimbal motor 18*a* that serves to pan the video camera 12 about the Y-axis 13, and a second gimbal motor 18*b* that serves to tilt the video camera 12 about the X-axis 15. The gimbal motors 18*a* and *b* are illustratively driven by digital type signals of the type that are generated by a systems control 28 and each responds incrementally to the control signals derived from the systems control 28 to an accuracy of at least one part in 1000 resolution over the total angle of rotation about each of the axes 13 and 15. As will be explained later, it is necessary to scan a field or array 38 and to sight with great accuracy the video camera 12 on those elements disposed at the most oblique angle, i.e., a far corner of the field 38, as shown in FIG. 5.

Figure 2:
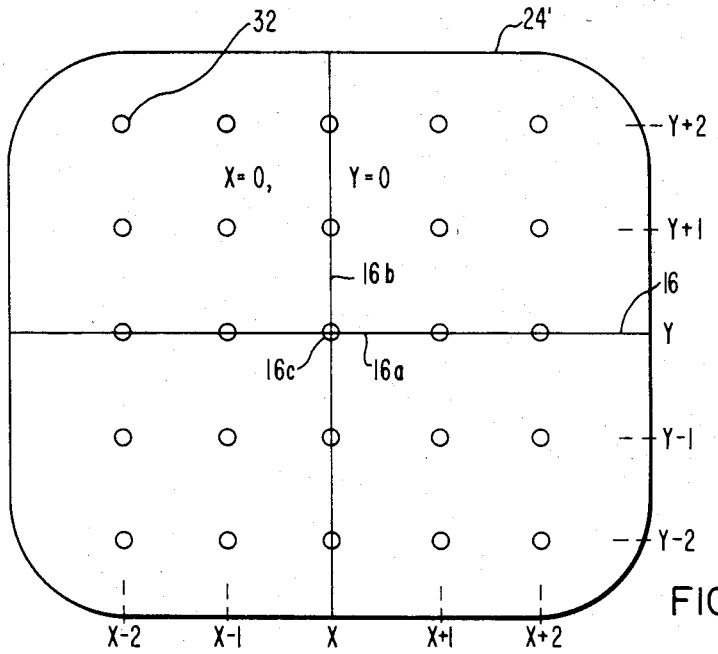
FIG. 2 is a representation of the image seen upon the monitor incorporated within the system of FIG. 1 and of a reticle image permitting the operator to sight the video camera upon the element.

As shown in FIGS. 1 and 5, the video camera 12 is associated with a lens 14 having a reticle 16 or cross hairs 16*a* and *b*, as illustrated in FIG. 2. FIG. 2 represents a displayed image of the image as seen by the video camera 12. As shown in FIG. 1, the video signal output from the camera 12 is applied to a set of camera controls 26 that outputs a signal to a typical monitor in the form of a CRT 24 to display the image sighted upon by the video camera 12. This image 24' is shown in FIG. 2 and illustrates the view seen by the video camera 12 as it sights upon the field 38 of tubes 32. As seen in FIG. 2, one of the tubes 32 having the coordinates X,Y is sighted upon, i.e., the video camera 12 is steered or adjustably disposed so that a center point or point of intersection 16*c* of the cross hairs 16*a* and 16*b* is precisely aligned with the tube 32X, Y. In addition, a set of overlay signals indicating the coordinate position of the sighted tube 32X, Y within the field 38 is also displayed as the CRT image 24'. As shown in FIG. 2, the sighted tube 32X, Y has the coordinate position X=0, Y=0. As will be explained, a microprocessor 22 generates and applies such overlay signals to the monitor 24.

As shown in FIGS. 1 and 5, the gimbal motors 18*a* and 18*b* are associated with corresponding gimbal angle sensors 20*a* and 20*b* to provide output signals to the microprocessor 22, indicative of the angle of rotation of the video camera 12 with respect to the X-axis 15 and the Y-axis 13. In particular, a gimbal angle sensor 20*a* is associated with the gimbal motor 18*a* and measures the pan angle $\theta$ that is formed between a line of sight of the camera 12 as it is rotated about the X-axis 15 with respect to the reference lines. Similarly, a gimbal angle sensor 20*b* is associated with the gimbal motor 18*b* and measures the tilt angle $\phi$ as formed between the line of sight of the video camera 12 and the Y-axis 13. As illustrated in FIG. 1, the output signals or manifestations indicative of the pan angle $\theta$ and the tilt angle $\phi$ are applied to the microprocessor 22, as shown in FIG. 1. Each of the gimbal angle sensor 20*a* and 20*b* may take the form of resolvers that provide an analog output signal in the form of a phase shifted sine wave, the phase shift being equal to the angles of rotation $\theta$ and $\phi$, respectively. In turn, as shown in FIG. 1, the output signals of the sensors 20 are applied to a resolver-to-digital converter 19 which provide, illustratively, a 12-bit digital output that is applied to an input/output (I/O) device 21, before being applied to the microprocessor 22.

Figure 6:
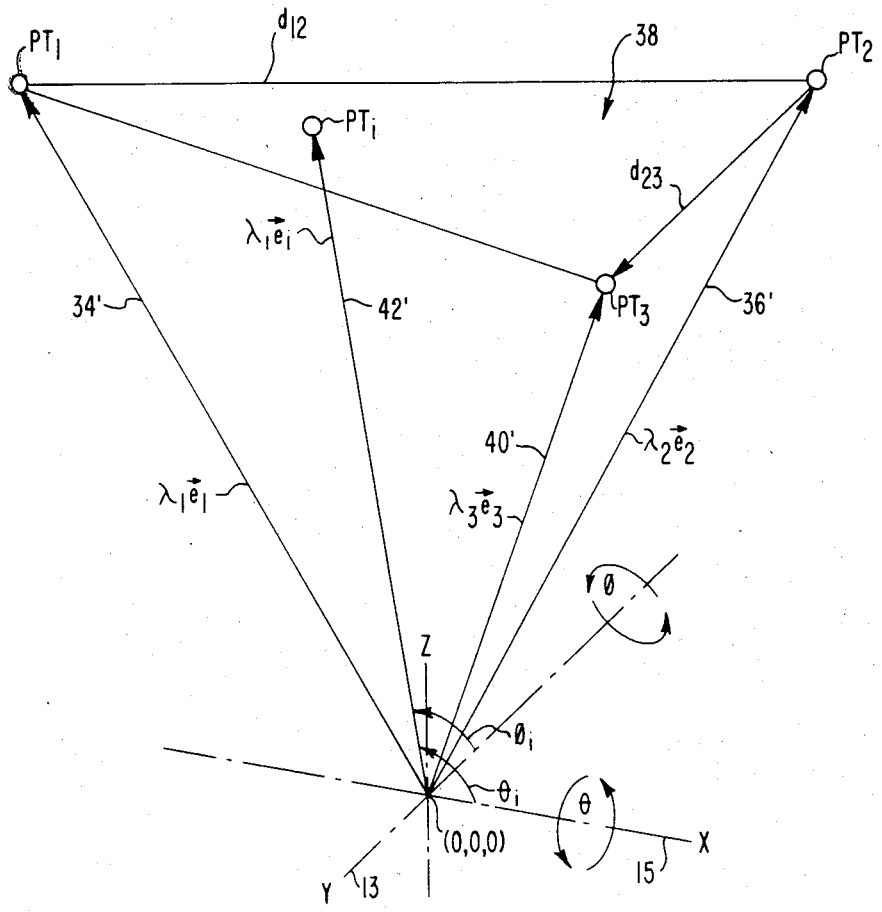

The microprocessor 22 includes as is well known in the art a programmable memory illustratively comprising a random access memory (RAM) that is loaded with a program for converting the input signals indicative of the pan and tilt angles $\theta$ and $\phi$ into an output manifestation indicative of the row/column indices or coordinates of that unknown tube 32 within the field 38 that has been sighted by the video camera 12. In order to provide the row/column coordinates of the sighted tube 32, the microprocessor 22 must first define or locate the plane of the array or tubesheet, i.e., that plane being defined by the ends of the tubes 32 as shown in FIG. 5, with respect to the system 10. To that end, the video camera 12 is sighted upon at least three data reference or known points $PT_1$, $PT_2$ and $PT_3$; these points may be those tubes 34, 36 and 40 that are disposed at the corner locations of the tubesheet plane or array 38 of tubes 32. As shown in FIGS. 5 and 6, the points $PT_1$, $PT_2$ and $PT_3$ are fixed or known points, and the distances $d_{12}$, $d_{13}$ and $d_{23}$ therebetween are known. A significant aspect of this invention is that the mapping and identifying system 10 may be disposed in any of a variety of positions with respect to the tubesheet plane 38. This is important in that the system 10 is typically disposed within the channel head 48 in a hurried manner in that the operator opens the manway 62, as shown in FIG. 4, and hurriedly places the system 10 upon the floor or bottom of the channel head 48, without exercising great care as to its relative position with regard to the tubesheet plane 38. As will be explained below, the video camera 12 is sighted upon the known points $PT_1$, $PT_2$ and $PT_3$ as are formed by the known ends of the tubes 34, 36 and 40, whereby the relative position of the system 10 with respect to the tubesheet plane 38 may be established. To this end, the video camera 12 is sighted along three reference lines 34', 36' and 40'; these reference lines establishing reference or unit vectors that define with a high degree of precision the relative position of the mapping and identifying system 10 to the tubesheet plane 38. As will be explained in detail later, the microprocessor 22 utilizes the set of output signals indicative of the $\theta_1,\phi_1$; $\theta_2,\phi_2$; and $\theta_3,\phi_3$ as derived from the gimbal angle sensors 20*a* and 20*b* respectively to define the reference or unit vectors along the reference lines 34', 36' and 40' toward the points $PT_1$, $PT_2$ and $PT_3$, respectively. Thereafter, the operator orients the video camera 12 along a sight line 42' to sight an unknown tube at point $PT_i$. The $\theta_i$ and $\phi_i$ outputs as now derived from the sensors 20*a* and 20*b* define a vector along the sight line 42', whereby the microprocessor 22 may calculate the position in terms of the X,Y coordinates of that unknown tube 32 lying at the point $PT_i$. As shown in FIG. 2, the microprocessor 22 superimposes the calculated values of these coordinates upon the CRT 24.

Further, as shown in FIG. 1, suitable means are provided whereby the video camera 12 may be oriented to sight along the sight line 42' any of the elements or tubes 32 within the field 38. To this end there is provided a suitable control in the form of a joystick 30 that may be readily grasped by the operator to selectively orient the video camera 12. The positioning control signals as provided by the joystick 30 are applied to the systems controls 28 which in turn apply signals to the gimbal motors 18*a* and 18*b* to move the camera 12, i.e., to rotate the camera in either direction about its vertical axis 13 and/or about its horizontal axis 15. As is apparent from the above discussion, the operator manipulates the joystick 30 while viewing the CRT image 24' until the point of intersection 16*c* of the reticle 16 is aligned with the element or tube 32 of interest. At that point, the displayed coordinate position indicates to the operator the exact coordinate position of the tube 32. Thereafter, the operator may readily enter the radioactive area within the channel head 48 and proceed directly to the identified tube 32. It is also contemplated within the teachings of this invention that any coordinate system other than the X,Y Cartesian system may be adopted without departing from the teachings of this invention.

In the case where a tube 32 is obscured from the video camera 12, a target having a sighting point may be attached to the tube 32 in a manner that the sighting point may be viewed directly by the video camera 12. The sighting point must bear a fixed relationship to the tube 32 to be sighted, and the relationship in terms of an "offset" can be entered into the microprocessor 22, whereby the microprocessor 22 can calculate the coordinate position of the sighted tube 32 based upon a sighting of the tube's sighting point and then adding in the known "offset" whereby the coordinates of the sighted tube 32 may be readily calculated and displayed upon the CRT 24. In an illustrative example, the target may be formed by a cylinder of known radius that is mounted in a concentric manner close to the end of the tube 32. In such a case, the offset would equal the radius so that when the operator sights the video camera 12 upon the edge of the cylinder, the microprocessor 22 "adds" the cylinder radius to the calculated position based upon the cylinder edge sighting to provide a correct coordinate position of the tube 32 itself. Similarly, a hand-held probe or target may be inserted into an end of a tube 32, whereby the operator could sight the video camera 12 on the hand-held probe. It is contemplated that the probe would be aligned with the peripheral surface of the tube 32 so that the offset to be used by the microprocessor 22 would correspond to the tube's radius, whereby the coordinate position of the tube's center may be readily calculated.

In an illustrative embodiment of this invention, the video camera and the camera control 26 may take the form of a Vidicon type tube as manufactured by Sony Corporation, under their designation AVC 7400, the gimbal mounting and gimbal motors 18 to permit rotation about the Y-axis 13 and X-axis 15 may take the form of such apparatus as manufactured by Clifton Precision, under their designation No. 08DM-1, the lens 14 with reticle may take the form of a zoom type lens as manufactured by Vicon Corporation, under their designation No. V11.5–9OMS, the gimbal angle sensors and the resolver-to-digital converter 19 may take the form of the resolver and converter as manufactured by Computer Conversion Company, under their designation Nos. R90-11-AE and DS90DB-12 respectively, the input/output device 19 may take the form of that device as manufactured by Interactive Structures under their designation No. DI$\phi$9, the microprocessor 22 may take the form of an Apple II Plus microprocessor as manufactured by Apple Computer under their designation No. A2S1048, and the systems controls 28 and the joystick 30 may take the form of an "Apple" compatible joystick as manufactured by T. G. Products, Inc.

The determination of the relative position of the mapping and identifying system 10 with respect to the tubesheet plane 38, and thereafter, the identification of the position of the unknown point $PT_i$ in terms of its coordinates within the tubesheet plane 38 will now be explained. As will become evident from the above discussion, the various determinations and calculations as set out below are effected by a program as stored within the RAM of the microprocessor 22. Initially, the relative position of the system 10 with respect to the tubesheet plane 38 is defined by the points $PT_1$, $PT_2$ and $PT_3$ as shown in FIG. 6 is unknown. To determine the relative position of the system 10, the video camera 12 is sighted upon the known points $PT_1$, $PT_2$ and $PT_3$ along the reference lines 34', 36' and 40', respectively. The reference lines are defined by three sets of camera angles (1) $\theta_1$, $\phi_1$, to define the reference line 34'; (2) $\theta_2$, $\phi_2$, to define the reference line 36'; and (3) $\theta_3$, $\phi_3$ to define reference line 40'. In turn, these angles and reference lines 34', 36' and 40' may be translated into unit vectors $\vec{e_1}$, $\vec{e_2}$ and $\vec{e_3}$ in accordance with the following transformation:

$$\vec{e_1}=(e_{ix}, e_{iy}, e_{iz}) \quad (1)$$

From transformation (1), it is seen that any unit vector $\vec{e_i}$ may be defined in terms of its components along the X, Y, and Z axes as shown in FIG. 6. The X, Y and Z components $e_{ix}$, $e_{iy}$, and $e_{iz}$ of the vector $\vec{e_i}$ may be expressed by the following formulas:

$$e_{ix}=\sin 2\phi_i \cos \theta_i$$
$$e_{iy}=\sin 2\phi_i \sin \theta_i \quad (2)$$
$$e_{iz}=\cos 2\phi_i$$

The above-defined unit vectors $\vec{e_1}$, $\vec{e_2}$, $\vec{e_3}$, are dimensionless and in order to define the distance from the video camera 12 to each of the points $PT_1$, $PT_2$ and $PT_3$, length multipliers or scalers $\lambda_1$, $\lambda_2$ and $\lambda_3$ are defined as shown in FIG. 6, i.e., the vector from the coordinate position 0,00 to $PT_1$ is $\lambda_1\vec{e_1}$. In vector notation, the distance $d_{12}$ between points $PT_1$ and $PT_2$, the distance $d_{13}$ between points $PT_1$ and $PT_3$, and the distance $d_{23}$ between point $PT_3$ and $PT_2$ are defined by the following equations:

$$|\lambda_1\vec{e_1}-\lambda_2\vec{e_2}|=d_{12}$$
$$|\lambda_1\vec{e_1}-\lambda_3\vec{e_3}|=d_{13} \quad (3)$$
$$|\lambda_2\vec{e_2}-\lambda_3\vec{e_3}|=d_{23}$$

In the above set (3) of transforms, the $\lambda_1$, $\lambda_2$, and $\lambda_3$ are unknown whereas the distances $d_{12}$, $d_{13}$ and $d_{23}$ may be measured from the known geometry of the tubesheet plane 38 of the tubes 32. As will become apparent, the set (3) of equations may be solved for the values of $\lambda_1$, $\lambda_2$ and $\lambda_3$, whereby the relative position of the tubesheet plane 38 may be defined with respect to the video camera 12, and an arbitrary point $PT_i$ corresponding to an unknown tube 32 may be located and defined in accordance with a linear combination of the vectors $\lambda_1\vec{e_1}$, $\lambda_2\vec{e_2}$, $\lambda_3\vec{e_3}$; vectors as lie along the reference lines 34', 36' and 40', by the following expression:

$$\vec{PT_i}=\vec{PT_1}\alpha_{1i}+\vec{PT_2}\alpha_{2i}+\vec{PT_3}\alpha_{3i} \quad (4)$$

where $\vec{PT_1}$ defines a vector corresponding to that vector $\lambda_i\vec{e_i}$ and $\vec{PT_1}$ defines a vector corresponding to $\lambda_1\vec{e_1}$, and $\alpha_{1i}$, $\alpha_{2i}$ and $\alpha_{3i}$ form a set of linear scalers to define that vector $\vec{PT_i}$ as disposed along the reference line 42' to the unknown point $PT_i$ within the tubesheet plane 38. The transform (4) may also be expressed as follows:

$$\vec{PT_i}=[PT_1, PT_2, PT_3]\vec{\alpha_i}=P\vec{\alpha_i} \quad (5)$$

wherein $\vec{\alpha_i}$ defines the set of scalers $\alpha_{1i}$, $\alpha_{2i}$ and $\alpha_{3i}$, P is an operator and the term $P_{\alpha i}$ defines a vector pointing toward the unknown point $PT_i$. In the special case, where each of the points $PT_1$, $PT_2$ and $PT_3$ all lie in the tubesheet plane 38, the following relation exists:

$$\alpha_{i1}+\alpha i_2+\alpha_{i3}=1 \tag{6}$$

The expression (4) defining the vector $\overrightarrow{PT_1}$ may be defined in terms of the vector notation $\lambda_i e_i$ as follows:

$$\lambda_i\vec{e_i}=\alpha_{i1}\lambda_1\vec{e_1}+\alpha_{i2}\lambda_2\vec{e_2}+\alpha_{i3}\lambda_3\vec{e_3} \tag{7}$$

The vector to the unknown point $PT_1$ may also be defined in terms of a matrix operator L as follows:

$$\lambda_i\vec{e_i}=[\lambda_1\vec{e_1},\ \lambda_2\vec{e_2},\ \lambda_3\vec{e_3}]\vec{\alpha_1}=L\vec{\alpha_i} \tag{8}$$

where the operator matrix L may be expressed as follows:

$$L=\begin{bmatrix} e_{1x} & e_{1y} & e_{1z} \\ e_{2x} & e_{2y} & e_{2z} \\ e_{3x} & e_{3y} & e_{3z} \end{bmatrix} \tag{9}$$

wherein $e_{ix}$, $e_{iy}$ and $e_{1x}$ define the X, Y and Z components of each of the unit vectors $\vec{e_1}$, $\vec{e_2}$ and $\vec{e_3}$.

The unit vector $\vec{e_i}$ as disposed along the sight line 42' as shown in FIG. 6 may be obtained by normalizing the expression $\lambda_i\vec{e_i}$ in accordance with the following:

$$e_i=\frac{\lambda_i\vec{e_i}}{\lambda_i\vec{e_i}}=(e_{ix},\ e_{iy},\ e_{iz}) \tag{10}$$

The output signals of the angle sensors 20a and 20b indicative of the values of $\phi_i$ and $\theta_i$ respectively, when the tube 12 is disposed to sight along sight line 42' to the unknown point $PT_i$, are measured variables, which are used to define the following expressions by using the following inverse vector to angle transformation:

$$\phi_i=\tfrac{1}{2}\cos^{-1} e_{iz} \tag{11}$$

$$\theta_i=\operatorname{sgn}(e_{iy})\cos^{-1}\frac{e_{ix}}{(e_{ix}^2+e_{iy}^2)^{\frac{1}{2}}} \tag{12}$$

The above expressions (11) and (12) directly relate the output signals of the angle sensors 20a and 20b indicative of $\theta_i$ and $\phi_i$ to the X, Y and Z components of the unit vector $\vec{e_i}$ oriented towards the unknown point $PT_i$. Further, expressions (11) and (12) given above define the relative position of the system 10 with respect to the tubesheet plane 38 and in particular defines the orientation or direction of the unit vector $\vec{e_i}$ the unknown point $PT_i$.

Next, it is necessary to convert the unit vector $\vec{e_i}$, which points to the unknown point $PT_i$, and is derived from the measured angles $\phi_i$ and $\theta_i$ to a set of coordinate positions, e.g., the X and Y coordinates or column and row position of the unknown tube 32 within the tubesheet plane 38. To this end, the unit vector $\vec{e_i}$ is defined in accordance with $\beta$ scalers that is related to the coordinate positions of the unknown point $PT_i$ within the tubesheet plane 38 as follows:

$$\vec{e_i}=\beta_{1i}\lambda_1\vec{e_1}+\beta_{2i}\lambda_2\vec{e_2}+\beta_{3i}\lambda_3\vec{e_3} \tag{13}$$

Expression (13) defines the vector $\vec{e_i}$ in terms of the reference unit vectors $\vec{e_1}$, $\vec{e_2}$, and $\vec{e_3}$, and the values of $\lambda_1$, $\lambda_2$, and $\lambda_3$. The reference unit vectors $\vec{e_1}$, $\vec{e_2}$, and $\vec{e_3}$ are defined respectively in terms of the sets of angles $\phi_1,\theta_1$; $\phi_2,\theta_2$, and $\phi_3,\theta_3$ as obtained from the sensors 20. The values of $\lambda_1$, $\lambda_2$, and $\lambda_3$ are derived by solving simultaneously three equations taken from the expression (3) above and expressions (20), (21) and (22) below. As will be evident $\lambda_1$, $\lambda_2$, and $\lambda_3$ are functions of the measured sets of angles $\phi_1,\theta_1$; $\phi_2,\theta_2$ and $\phi_3,\theta_3$ and the known distances $d_{12}$, $d_{23}$ and $d_{13}$ as shown in FIG. 6. $\beta$ is a scaler set of numbers relating the values of $\phi_1,\theta_1$; $\phi_2,\theta_2$, and $\phi_3,\theta_3$, and $\lambda_1$, $\lambda_2$, and $\lambda_3$ to the unit vector $\vec{e_i}$, which is defined in terms of $\phi_i,\theta_i$.

Noting the definition of the matrix operator L as set out in expressions (8) and (9) above, each of the transforms as seen in expression (13) is divided by the inverse or reciprocal of the matrix operator L, i.e., $L^{-1}$, to provide the following expression:

$$\vec{\beta_i}=L^{-1}\vec{e_i} \tag{14}$$

where $\beta_i$ is defined by the following expression:

$$\vec{\beta_i}=[\beta_{1i},\ \beta_{2i},\ \beta_{3i}] \tag{15}$$

Next, the scaler operator $\beta_i$ is transformed to the special case wherein the end points of the vectors $\beta_{1i}$, $\beta_{2i}$ and $\beta_{3i}$ lie in the tubesheet plane 38 by the following expression:

$$\vec{\beta_i}^{1}=\frac{\vec{\beta_i}}{\sum_{j=1}^{3}\beta_{ji}} \tag{16}$$

The denominator of the expression (16) indicates a summarizing operation in accordance with the following expression:

$$\sum_{j=1}^{3}\beta_{ji}=\frac{\beta_{1i}}{\beta_{1i}+\beta_{2i}+\beta_{3i}}+\frac{\beta_{2i}}{\beta_{1i}+\beta_{2i}+\beta_{3i}}+\frac{\beta_{3i}}{\beta_{1i}+\beta_{2i}+\beta_{3i}} \tag{17}$$

The converting of the scaler $\beta_i$ to $\beta^1{}_i$ by the expression (16) ensures that the following condition is met:

$$\beta_{1i}+\beta_{2i}+\beta_{3i}=1 \tag{18}$$

and further constrains all points defined by the vector $\vec{e_i}$ to lie within the tubesheet plane 38. Thus $\beta^1{}_i$ is a scaler defined in terms of the three dimensional values $\lambda_1\vec{e_1}$, $\lambda_2\vec{e_2}$, and $\lambda_3\vec{e_3}$ as taken from the expression (13) and the values of $\phi_i,\theta_i$, and relates these values to the two dimensions of the tubesheet plane 38. The matrix operator P as defined above by expression (5) is seen to be an ordered set or three-by-three array of numbers describing the known points $PT_1$, $PT_2$, and $PT_3$ in the tubesheet plane 38 and is used by the following expression to relate any vector $\vec{e_i}$ to the points in the tubesheet plane 38:

$$\vec{PT_i}=P\vec{\beta_i}^{1} \tag{19}$$

where $\vec{PT_i}$ is the coordinate position of the unknown point as pointed to by vector $\vec{e_i}$ in terms of its X,Y coordinates within the tubesheet plane 38. Thus, expression (19) demonstrates the relationship between the measured camera angles $\theta_i$ and $\phi_i$, which define $\vec{e}_i$, and the calculated values of $\lambda_1$, $\lambda_2$ and $\lambda_3$ (as derived from the measured angles $\phi_1,\theta_1$; $\phi_2,\theta_2$ and $\phi_3,\theta_3$) to the X,Y coordinate position of the unknown point in the tubesheet plane 38.

From FIG. 6, it is seen that the unknown scalers or length multipliers $\lambda_1$, $\lambda_2$ and $\lambda_3$ are a function of the known distances $d_{12}$, $d_{13}$, and $d_{23}$, or $d_{kl}$ where k and l are the end points of the "d" distances and may be expressed by the following expression:

$$(\lambda_k^2+\lambda_l^2-2\lambda_k\lambda_l\cos(\vec{e}_k,\vec{e}_l))^{\frac{1}{2}}=d_{kl} \tag{20}$$

By solving simultaneously each of the three equations for each of the distances $d_{12}$, $d_{23}$ and $d_{13}$, the values of $\lambda_1$, $\lambda_2$, $\lambda_3$, may be provided. As explained above, the distances $d_{12}$, $d_{13}$ and $d_{23}$ correspond to the distances between the tubes 34 and 36, 36 and 40 and 34. The expression (20) may be solved by using a Newton-Raphson procedure wherein an initial estimate of the distances $\lambda_1^{(o)}$, $\lambda_2^{(o)}$, $\lambda_3^{(o)}$ is assumed. The distance equations in accordance with expression (20) may be expanded in a linear Taylor series about the initial estimate. The resultant linear equations are solved for the $\lambda_i$ changes $\Delta\lambda_1$, $\Delta\lambda_2$, $\Delta\lambda_3$, which are then added to the initial guesses. This procedure is repeated or reiterated until there is convergence. It has been found that at most five iterations are required to obtain an accuracy of 15 decimal places of the value of $\lambda_i$ starting with a reasonable estimate $\lambda^{(o)}$. After each iteration, a value of $\Delta\lambda_k$ is added to the previous estimate resulting from the Taylor series expansion, which may be expressed as follows:

$$\frac{\lambda_k^{(o)}-\lambda_l^{(o)}\cos(e_k,e_l)}{d_{kl}^{(o)}}\Delta\lambda_k+\frac{\lambda_l^{(o)}-\lambda_k^{(o)}\cos(e_k e_l)}{d_{kl}^{(o)}}\Delta\lambda_l=d_{kl}-d_{kl}^{(o)} \tag{21}$$

where $$d_{kl}^{(o)}=(\lambda_k^{(o)2}+\lambda_l^{(o)2}-2\lambda_k^{(o)}\lambda_l^{(o)}\cos(e_k,e_l))^{\frac{1}{2}} \tag{22}$$

The notation cos $(e_k,e_l)$ refers to the cosine of the angle between the vectors $e_k$ and $e_l$, and may be derived, as is well known in the art, by taking the dot product between the vectors $\vec{e}_k$ and $\vec{e}_l$. These cosine values are inserted into the expression (21) and solved for the values of $\lambda_1$, $\lambda_2$, $\lambda_3$, which are used with the measured values of $\phi,\theta$, in accordance with the expression (19) to provide the values X, Y of the unknown point within the tubesheet plane 38, i.e., $PT_i$. The reiterative process of solving the expression (20) is particularly adapted to be effected by the programmed microprocessor 22, as will be explained below.

The microprocessor 22 has a RAM that is programmed with a program written in the well-known BASIC language to effect the various steps for calculating the reference vectors $\lambda_1\vec{e}_1$; $\lambda_2\vec{e}_2$ and $\lambda_3\vec{e}_3$ based upon three sets of angles $\theta_1,\phi_1$; $\theta_2,\phi_2$ and $\theta_3,\phi_3$ as well as the known distances $d_{12}$, $d_{13}$ and $d_{23}$ between three reference points $PT_1$, $PT_2$ and $PT_3$ within the tubesheet plane 38, as well as to effect the calculation of the coordinate points X,Y within the tubesheet plane 38 of the unknown point $PT_i$ based upon the measurements of the angles $\theta_i$ and $\phi_i$ from the angle sensors 20*a* and *b*. An illustrative example of a particular program in the noted language, is set out below as follows:

LIST

```
9  DIM V(3,3),LA(3),DI(3),CO(3),ED(3),DF(3),DL(3),UA(3),BI(3),RC(3),TT(3,3),EI(3),LI(3,3)
10  REM  READ ANGLES
11 A$ = ","
12 B$ = " "
13  DIM T(3,3),LE(3,3),MI(3,3)
14  DIM TG(3,3),MA(3,3),E(3,3),AG(3,3),OO(3,6),O9(3,3)
15  GOTO 100
20 TB =  PEEK (DI):TA =  PEEK (DI + 1)
30 T1 = ((TB - 16 *  INT (TB / 16)) * 256 + TA) * .08789
40 TB =  PEEK (DI + 16):TA =  PEEK (DI + 17)
50 T2 = ((TB - 16 *  INT (TB / 16)) * 256 + TA) * .08789
60 T2 = T2 + 75.8
70 T1 = T1 - 127.528
80  PRINT "TH1=";T1,"TH2=";T2;
90 DR = 57.2957:T1 = T1 / DR:T2 = T2 / DR
95  RETURN
100  REM  SET UP INTERFACE WITH DIO9
110 SLOT = 3
120 DI =  - 16384 + SLOT * 256
130  POKE DI + 2,0: POKE DI + 3,0: POKE DI + 18,0: POKE DI + 19,0
140  POKE DI + 11,0: POKE DI + 27,0
150  REM
240  FOR I = 1 TO 3
245  READ TG(I,1),TG(I,2)
250  PRINT TG(I,1);B$;TG(I,2)
260  NEXT I
265  DATA  1,1,1,100,48,40
270  PRINT "THOSE ARE THE TARGET POINTS, WHETHER YOU LIKE THEM OR NOT!"
320  FOR I = 1 TO 3
330  PRINT "FOR TARGET ";TG(I,1);A$;TG(I,2);B$;"PLEASE MOVE THE POINTER AND INPUT CR"
335  INPUT Y$
340  GOSUB 20
348 AG(I,1) = T1:AG(I,2) = T2
```

```
350  NEXT
351  PRINT "THESE ARE THE TARGET HOLES WITH ANGLES"
352  PRINT : FOR I = 1 TO 3: PRINT TG(I,1);A$;TG(I,2),,AG(I,1);A$;AG(I,2): NEXT I: PRINT
380  REM  INPUT SECTION FINISHED
390  FOR I = 1 TO 3
400 TX2 = 1 * AG(I,2):T1 = AG(I,1)
410 E(I,3) =  COS (TX2)
420 E(I,1) =  SIN (TX2) *  COS (T1)
430 E(I,2) =  SIN (TX2) *  SIN (T1)
440  PRINT "UNIT VECTOR ";I,E(I,1);A$;E(I,2);A$;E(I,3)
450  NEXT I
460  REM
500  REM  UNIT VECTORS CALCULATED AND IN E
510  REM
900 LA(1) = 50 *  SQR (2):LA(2) = LA(1):LA(3) = LA(2)
910 DI(1) = 99:DI(2) = 61.46:DI(3) = 76.53
920 CO(1) = E(1,1) * E(2,1) + E(1,2) * E(2,2) + E(1,3) * E(2,3)
930 CO(2) = E(1,1) * E(3,1) + E(1,2) * E(3,2) + E(1,3) * E(3,3)
940 CO(3) = E(2,1) * E(3,1) + E(2,2) * E(3,2) + E(2,3) * E(3,3)
950  PRINT
970  FOR I = 1 TO 3: PRINT "LAMBDA(";I;")  =  ";LA(I): NEXT I
990  PRINT
1000  REM
1010  FOR I = 1 TO 3: FOR J = 1 TO 3
1020 LE(I,J) = LA(I) * E(I,J)
1030  NEXT J: NEXT I
1060  FOR J = 1 TO 3
1070 V(1,J) = LE(1,J) - LE(2,J)
1080 V(2,J) = LE(1,J) - LE(3,J)
1090 V(3,J) = LE(2,J) - LE(3,J)
1100  NEXT J
1110  FOR I = 1 TO 3
1120 ED(I) =  SQR (V(I,1) © 2 + V(I,2) © 2 + V(I,3) © 2)
1130  NEXT I
1140  FOR I = 1 TO 3:DF(I) = DI(I) - ED(I): NEXT I
1150  REM
1160  REM  NOW DEFINE MA(I,J)
1170  REM
1200 MA(1,1) = (LA(1) - LA(2) * CO(1)) / ED(1)
1210 MA(1,2) = (LA(2) - LA(1) * CO(1)) / ED(1)
1220 MA(2,1) = (LA(1) - LA(3) * CO(2)) / ED(2)
1230 MA(2,3) = (LA(3) - LA(1) * CO(2)) / ED(2)
1240 MA(3,2) = (LA(2) - LA(3) * CO(3)) / ED(3)
1250 MA(3,3) = (LA(3) - LA(2) * CO(3)) / ED(3)
1260 MA(1,3) = 0:MA(2,2) = 0:MA(3,1) = 0
1270  FOR I = 1 TO 3: FOR J = 1 TO 3
1280 CO(I,J) = MA(I,J)
1290  NEXT J: NEXT I
1300  REM
1310  REM  NOW WE INVERT THE MATRIX MA
1320  GOSUB 60000
1330  FOR I = 1 TO 3: FOR J = 1 TO 3
1340 MI(I,J) = O9(I,J)
1350  NEXT J: NEXT I
1400  REM
1410  FOR I = 1 TO 3
1420 DL(I) = 0
1425  FOR J = 1 TO 3
1430 DL(I) = DL(I) + MI(I,J) * DF(J)
1440  NEXT J: NEXT I
1450  FOR I = 1 TO 3:LA(I) = LA(I) + DL(I): NEXT I
1470  FOR I = 1 TO 3: PRINT "LAMBDA(";I;")  =  ";LA(I): NEXT I
1475  PRINT : PRINT
1480  IF  SQR (DL(1) © 2 + DL(2) © 2 + DL(3) © 2) > 1.0E - 4 THEN 1000
1490  PRINT : PRINT
1495  REM  REPEAT UNTIL ABS(DIFF)<.0001
1496  FOR I = 1 TO 3: FOR J = 1 TO 3
1497 LE(J,I) = E(I,J) * LA(I): NEXT J: NEXT I
1500  REM
```

```
1510  FOR I = 1 TO 3
1520  PRINT "VECTOR (";I;") = ";LE(1,I);A$;LE(2,I);A$;LE(3,I)
1530  NEXT I
1535  PRINT
1540  FOR I = 1 TO 3: FOR J = 1 TO 3:OO(I,J) = LE(I,J): NEXT J: NEXT I
1560  GOSUB 60000
1570  FOR I = 1 TO 3: FOR J = 1 TO 3:LI(I,J) = O9(I,J): NEXT J: NEXT I
1580  REM  NOW WE HAVE A TRANSFORMATION INTO THE PLANE OF THE TUBESHEET
1590  FOR I = 1 TO 3: FOR J = 1 TO 3:TT(J,I) = TG(I,J): NEXT J: NEXT I
1600  REM  TT IS THE TRANSPOSE OF THE TARGET VECTOR
1610  REM  NOW INPUT THE UNKNOWN VECTOR
1620  GOSUB 20
1629 UA(1) = T1:UA(2) = T2
1640 TX2 = 1 * UA(2):T1 = UA(1)
1650 EI(3) =  COS (TX2)
1655 EI(2) =  SIN (TX2) *  SIN (T1)
1660 EI(1) =  SIN (TX2) *  COS (T1)
1666  REM  NOW WE HAVE THE UNKNOWN VECTOR IN EI
1670 S = 0
1680  FOR I = 1 TO 3
1690 B(I) = 0
1700  FOR J = 1 TO 3
1710 B(I) = B(I) + LI(I,J) * EI(J)
1720  NEXT J
1725 S = S + B(I)
1730  NEXT I
1750  FOR I = 1 TO 3:B(I) = B(I) / S: NEXT I
1760  FOR I = 1 TO 2:RC(I) = 0
1770  FOR J = 1 TO 3
1780 RC(I) = RC(I) + TT(I,J) * B(J)
1790  NEXT J: NEXT I
1800  REM
1810  PRINT " R/C:";RC(1);",";RC(2)
1830  GOTO 1600
1840  IF Y$ <  > "N" THEN 1600
1850  STOP
1860  REM
1870  REM ***************************
```

Referring now to the above program by the indicated line numbers, the steps at lines 10 to 95 describe an input subroutine whereby the outputs from the gimbal sensors 20 and in particular the resolvers are converted into digital numbers by the converter 19 and input into port 3 of the microprocessor 22. In particular, the steps at lines 60 and 70 operate on the output of the resolver or angle sensors 20 to subtract the inherent shift angle of the phase angle from a reference point, which shift angle is dependent upon the particular sensors 20 incorporated in the system 10. The steps at lines 100 to 150 initialize port 3 of the microprocessor 22. The steps at lines 240 to 260 cause a message to be displayed upon the CRT 24 telling the operator to sight the video camera 12 or the reference tubes 34, 36 and 40, identifying these tubes within the tubesheet plane 38 by their row and column as 1,1; 1,100 and 48,40. The steps beginning at line 335 permits the operator to manipulate the joystick 30 to input the three sets of angles $\theta_1,\phi_1$; $\theta_2,\phi_2$ and $\theta_3,\phi_3$. After the video camera 12 has been sighted for each of 3 times, the corresponding sets of angle signals $\theta_1,\phi_1$ for the sighting along reference line 34', angle signals $\theta_2,\phi_2$ for the sighting along sighting line 36', and angle signals $\theta_3,\phi_3$ for the sighting along sighting line 40' are stored by the step at line 348 in a dedicated location of the microprocessor's RAM.

Next, the steps at lines 390 to 450 calculates the X, Y and Z components of the unit vectors $\vec{e_1}$, $\vec{e_2}$, $\vec{e_3}$ in accordance with the equation (2), thus providing three component values for each vector for a total of nine values. Next, the step at line 900 calls the initial estimates for the length multipliers or scalers $\lambda_1^{(o)}$, $\lambda_2^{(o)}$, $\lambda_3^{(o)}$ from a known location in the RAM, and the step at line 910 reads out the known distances $d_{12}$, $d_{13}$ and $d_{23}$ as shown in FIG. 6 from the microprocessor's RAM. Next the steps at lines 920 to 940 calculate the cosine values of the angles between the unit vectors $\vec{e_1}$, $\vec{e_2}$, $\vec{e_3}$ as by taking the dot product of the two vectors, i.e., the cosine of the angle between the vectors $e_1$ and $e_2$ is equal to $\vec{e_1}$, $\vec{e_2}$. The step at line 970 displays the initially assumed values of the scalers $\lambda^{(o)}$, and in the steps as shown at lines 1000 to 1480, the iteration solving of expressions (21) and (22) in accordance with the Newton-Raphson procedure is effected. In particular, a first approximation of the distance $d_{kl}^{(o)}$ is carried out by the steps at line 1100 to 1130 in accordance with the expression (21). At the step of line 1140, the difference of $d_{kl}-d_{kl}^{(o)}$ is calculated and the difference value is used to solve by the steps of lines 1200–1260 the three equations defining the given distances $d_{12}$, $d_{13}$ and $d_{23}$ according to the expression (20) for the unknown values of $\lambda_k$ and $\lambda_l$. In the step at line 1280 the matrix of these three equations is formed in accordance with the expression (21), and in step 1320, an inversion thereof is taken by going to subroutine 6000, which performs an inversion operation by the well-known Gauss Jordan elimination process before returning to the main procedure. Next in the step at line 1430, each side of the expression (21) is multiplied by the inverted matrix to solve for the unknown values of $\Delta\lambda_k$ and $\Delta\lambda_l$ that are to be used in the above Taylor series expansion. Next in the step at line 1450, the calculated values of $\Delta\lambda$ are added to the previous values of $\lambda$, before in the step at line 1480, the square root of the calculated values of $\Delta\lambda_k$, $\Delta\lambda_l$ is squared and the square root of their sum is taken; thereafter the calculated sum is compared with an arbitrary small value and if less, it is known that the iteration error has grown to a sufficiently small level to achieve the desired degree of accuracy of the values of $\lambda_1$, $\lambda_2$, $\lambda_3$, i.e., the three equations according to the expression (21) have been solved for $\lambda_1$, $\lambda_2$, $\lambda_3$. Next in the step at line 1497, values of each of $\lambda_i, \vec{e_i}$ are obtained so that they may be inserted into expression (14) to solve for $\vec{\beta_i}$. Next in the step at 1540, the matrix L is called and the invention thereof is calculated by the subroutine called at line 1560 in accordance with the well-known Gauss Jordan elimination procedure. By the use of the matrix $L^{-1}$, the program begins at the step of line 1580 to calculate the coordinates of the unknown point, i.e., $PT_i$. Beginning at the steps of line 1620, the vector $\vec{e_i}$ is called as follows: First, the output of the gimbal sensors 20 for the angles $\theta_i$ and $\phi_i$ and the X, Y and Z component values of the vector $\vec{e_i}$ are calculated in the steps at line 1650 to 1660 to thereby define the vector $\vec{e_i}$ in accordance with the expression (L) stated above. Next, the step at line 1710 calculates the vector matrix $\vec{\beta_i}$ by taking the product of the matrix $L^{-1}$ and the vector $\vec{e_i}$ in accordance with expression (14). In order to reduce the vector scaler $\vec{\beta_i}$ to the special case $\vec{\beta_i}^1$ to ensure that the points $PT_1$, $PT_2$, $PT_3$ lie in the tubesheet plane 38, the value of $$\sum_{j=1}^{3} \beta_{ji}$$

is calculated at the step of line 1750 in accordance with the expression (16). Next in the steps at lines 1760 to 1790, the coordinate values as obtained from the expression (19) are calculated. Finally in the step at line 1810, the coordinate values of the unknown point $PT_i$ in terms of the row and column or X and Y values of the unknown tube 32 are displayed upon the CRT 24.

It is contemplated within the teachings of this invention that the systems controls 28 which respond to the operator manipulated joystick 30, could be applied to the microprocessor 22 whereby the microprocessor 22 directs the gimbal motors 18*a* and *b* to a known position. In such an embodiment, the tilt and pan angles $\phi$ and $\theta$ are set by the microprocessor 22 and it would not be necessary to employ the gimbal angle sensors 20 as shown in the embodiment of FIG. 1. In a further aspect of this invention, the microprocessor 22 may be coupled to a video tape recorder, whereby the tube selection process and the indicated coordinate values can be readily stored.

Thus, there has been shown a mapping and identifying system that has significant advantages over the prior art systems. The present system eliminates the need for the operator to manipulate both a light source and an image sensor. Rather in accordance with the teachings of this invention, the operator manipulates only a sighting means in the form of a video camera. In addition, the built-in reticle provides a drift-free reference for all sightings and permits the use of readily available video equipment including a video camera, camera controls and display equipment. In like manner, the gimbal motors and sensors are readily available devices that provide digital output signals that are readily adapted to be processed by the microprocessor 22. The microprocessor 22 performs the repetitive operations of converting the gimbal angle signals to row/column manifestations, as well as the calculation of the reference or plane in which the tube ends are disposed. A significant advantage of this system is that the length of stay within the channel head or housing in which there is a high level of radiation, is substantially reduced in that the operator may readily find the tube of interest.

In considering this invention, it should be remembered that the present disclosure is illustrative only and the scope of the invention should be determined by the appended claims.

I claim:

1. Apparatus for identifying an element of a plurality of elements disposed within a field having at least first, second and third reference means, said apparatus comprising:

sighting means defining a line of sight to intersect an element of said plurality of elements and mounted to be operator manipulated so that said line of sight may intersect any of said plurality of elements, said sighting means being variably disposed in an unknown position with respect to said field, whereby a reference line is formed between said unknown position and said field;

orientation sensing means coupled to said sighting means for providing an angle signal indicative of the angle between said reference line and said line of sight and for providing a set of angle signals when said line of sight intersects said first, second, and third reference means for determining the plane of said field as defined by said first, second and third reference means; and computing means responsive to said angle signal for identifying the position within said field of said element sighted by said sighting means.

2. The identifying apparatus as claimed in claim 1, wherein said sighting means comprises a radiation image sensing means operator disposable along said sight line to provide a video signal of said element as sensed by said radiation image sensing means.

3. The identifying apparatus as claimed in claim 2, wherein said sighting means further comprises operator-controllable means coupled to said image sensing means for selectively orienting said image sensing means with respect to said reference line to view along said sight line a selected portion of said field.

4. The identifying apparatus as claimed in claim 3, wherein there is further included display means coupled to receive said video signal to provide a visual display of said selected portion of said field, whereby an operator may selectively manipulate said operator controllable means to position said radiation image sensing means so that its line of sight intersects said element, whose image is displayed upon said display means.

5. The identifying apparatus as claimed in claim 3, wherein there is further included reticle means disposed to intersect the visual image sensed by said radiation imaging sensing means for defining thereby said sight line.

6. The identifying apparatus as claimed in claim 5, wherein said reticle means comprises first and second lines intersecting each other, the point of intersection of said first and second lines defining said sight line.

7. The identifying apparatus as claimed in claim 1, wherein each element of said plurality of elements is identified by an X and Y coordinate value, and said computing means comprises means responsive to said angle signal for providing signals identifying the X, Y coordinates of said element as intersecting said line of sight.

8. The identifying apparatus as claimed in claim 7, wherein there is included means responsive to said X, Y coordinate signals for applying them to said display means, whereby a visual manifestation of said X, Y coordinate signals is superimposed upon an image of a selected field portion.

9. The identifying apparatus as claimed in claim 7, wherein said computing means comprises a digital computer programmed to effect computation for providing said X, Y coordinates of said element.

10. Apparatus for determining an unknown position of an object with a field, said field having a known position and comprising first, second and third reference objects which define a plane of said field, said determining apparatus comprising:

(a) sighting means having a set of reference axes and disposable in an unknown position with respect to said field plane, said sighting means defining a line of sight and being mounted to be variably disposed so that said line of sight intercepts each of said first, second and third reference points to define first, second and third reference sight lines and intersects said object to define an object sight line;

(b) orientation sensing means coupled to said sighting means for providing first signals indicative of sets of angles between said axes and each of said first, second and third reference sight lines respectively and second signals indicative of the angles between said axes and said object sight line; and (c) data processing means comprising first means responsive to said first signals for determining the unknown position of said sighting means, and second means responsive to said second signals for determining the unknown position of said object within said plane to provide a manifestation indicative thereof.

11. Determining apparatus as claimed in claim 10, wherein there is included means for applying known distances between said first and second reference objects, said second and third reference objects and said first and third reference objects to said data processing means, whereby said first means determines first, second and third vectors corresponding to said first, second and third reference sight lines, respectively.

12. Determining apparatus as claimed in claim 11, wherein said second means determines a vector defining said object sight line and a set of angles between said object sight and each of said first, second and third reference vectors.

13. Said determining apparatus as claimed in claim 12, wherein said second means comprising means for providing X, Y coordinates of said unknown position of said object within said field.

* * * * *